US008475193B2

(12) United States Patent
Kawashima

(10) Patent No.: US 8,475,193 B2
(45) Date of Patent: Jul. 2, 2013

(54) ELECTRICAL CABLE CONNECTOR AND ELECTRICAL CABLE CONNECTOR ASSEMBLED MEMBER

(75) Inventor: Hiroshi Kawashima, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 13/221,120

(22) Filed: Aug. 30, 2011

(65) Prior Publication Data

US 2012/0058690 A1 Mar. 8, 2012

(30) Foreign Application Priority Data

Sep. 3, 2010 (JP) ..... 2010-198251

(51) Int. Cl.
*H01R 13/28* (2006.01)

(52) U.S. Cl.
USPC ..... 439/284; 439/927

(58) Field of Classification Search
USPC ..... 439/595, 284, 295, 660, 825
See application file for complete search history.

(56) References Cited

U.S. PATENT DOCUMENTS 2,988,726 A * 6/1961 Agron et al. ..... 439/723
3,688,243 A * 8/1972 Yamada et al. ..... 439/293
3,701,965 A * 10/1972 DuRocher et al. ..... 439/86
4,252,391 A * 2/1981 Sado ..... 439/91
4,703,986 A * 11/1987 McCormick ..... 439/607.12
7,371,095 B2 * 5/2008 Takahashi ..... 439/261

FOREIGN PATENT DOCUMENTS

JP 2005-235473 A 9/2005
JP 2006-216490 A 8/2006
JP 2008-270155 A 11/2008

* cited by examiner

*Primary Examiner* — Phuong Dinh

(74) *Attorney, Agent, or Firm* — Kubotera & Associates LLC

(57) ABSTRACT

A cable connecting configuration electrically connects cables with a terminal attached to one end of each of the cables. The cable connecting configuration has a contact section having a contact surface parallel to a longitudinal direction of the cables. In a state that the cables are connected to each other, the contact section of each of the terminals is provided to face each other having an overlapping range in the longitudinal direction, with the facing direction being a direction perpendicular to the contact surface of the contact section. Between the contact surfaces, there is a metal elastic member, which can be elastically displaced in the facing direction within the overlapping range. The terminal is held by the housing such that the contact sections tightly press the elastic member in the facing direction, and thereby the terminals are electrically connected via the elastic member.

7 Claims, 6 Drawing Sheets

ELECTRICAL CABLE CONNECTOR AND ELECTRICAL CABLE CONNECTOR ASSEMBLED MEMBER

BACKGROUND OF THE PRESENT INVENTION AND RELATED ART STATEMENT

The present invention relates to a cable connecting configuration, an electrical cable connector, and an electrical cable connector assembled member.

As a conventional compact connecting configuration for electrically connecting two cables, for example, Patent Reference has disclosed a configuration, in which cables are connected via a relay electrical connector. According to Patent Reference, the relay electrical connector has a tubular body as a housing that extends in a longitudinal direction of the cables. Further, the relay electrical connector has hollow terminal housing sections formed at a middle part of the tubular body in the longitudinal direction of the cables. Further, two terminals to be correspondingly connected to the respective cables are provided within the hollow terminal housing sections at positions different in the longitudinal direction.

Patent Reference: Japanese Patent Publication No. 2005-235473

According to Patent Reference, the terminal includes an electrical continuity section that has a frame-like shape and receives a core wire of the cable. The terminal also includes a spring contact section that presses the core wire of the cable against the electrical continuity section. The electrical continuity sections of the two terminals are joined to each other, being formed of one sheet metal as one member, and thereby electrical continuity is made between the two terminals.

When an end section of each cable is inserted from the end sections of the tubular body of the electrical connector having such configuration, the core wire exposed at the end section enters between the electrical continuity section of the terminal and the spring contact section. The core wire is pressed against the electrical connecting section by the spring contact section to contact with the electrical connecting section, and as a result, the electrical continuity is made between the two cables via the two terminals.

According to the electrical connector disclosed in Patent Reference, the two terminals are provided at the different positions in the longitudinal direction, so that the electrical connector and the cable connecting configuration become large in the longitudinal direction.

In view of the problems described above, an object of the present invention is to provide a cable configuration having a small size in a longitudinal direction of a cable, an electrical cable connector, and an electrical cable connector assembled member having the electrical cable connector.

Further objects and advantages of the present invention will be apparent from the following description of the present invention.

SUMMARY OF THE PRESENT INVENTION

In order to attain the objects described above, according to an aspect of the present invention, a cable connecting configuration electrically connects cables with a terminal attached to one end of each of the cables.

According to the present invention, the cable connecting configuration has a contact section having a contact surface parallel to a longitudinal direction of the cables. In a state that the cables are connected to each other, the contact section of each of the terminals is provided to face each other having an overlapping range in the longitudinal direction, with the facing direction being a direction perpendicular to the contact surface of the contact section. Between the contact surfaces, there is a metal elastic member, which can be elastically displaced in the facing direction within the overlapping range. The terminal is held by the housing such that the contact sections tightly press the elastic member in the facing direction, and thereby the terminals are electrically connected via the elastic member.

According to the present invention, in a state that the cables are connected to each other, the contact sections of the terminals are electrically connected via the elastic member while securing a desired contact pressure by tightly pressing the elastic member in the facing direction within the overlapping range in the longitudinal direction of the cables. Further, the contact sections are provided having the overlapping range in the longitudinal direction. Accordingly, it is possible to reduce a dimension of the cable connecting configuration in the longitudinal direction by an amount of the overlapping range.

According to the present invention, an electrical cable connector electrically connects cables with a terminal attached to one end of each of the cables.

According to the present invention, in the electrical cable connector, each terminal has a contact section, which has a contact surface parallel to a longitudinal direction of the cables. The electrical cable connector has a housing, which has receiving recesses to receive the contact sections having an overlapping range in the longitudinal direction with a facing direction thereof being a direction perpendicular to the contact surface of the contact section. The electrical cable connector also has a metal elastic member that is held by the housing and partially protrudes within the overlapping range into the receiving recesses.

According to the present invention, the elastic member can be elastically displaced in the facing direction, and each terminal is held by the housing such that the contact sections tightly press the elastic member by the contact surfaces of the contact sections in the facing direction in a state that the cables are connected to each other. Accordingly, the terminals are electrically connected to each other via the elastic member.

According to the present invention, the contact sections of the terminals electrically connect to each other via the elastic member while securing desired contact pressure by tightly pressing the elastic member in the facing direction within the overlapping range in the longitudinal direction in the state that the cables are connected to each other. Further, the contact sections are provided to have the overlapping range in the longitudinal direction. Accordingly, it is possible to reduce a dimension of the electrical connector in the longitudinal direction.

According to the present invention, a support surface of each receiving recess of the housing is preferably formed in the overlapping range of the contact sections for supporting the contact section of each terminal and keeping the state that the contact sections tightly press the elastic member.

In the state that the cables are connected to each other, the support surface of each receiving recess of the housing supports the contact sections of the terminals in the facing direction. Accordingly, even when the cables or the electrical connector vibrate in the facing direction, it is possible to maintain the state of tightly pressing the elastic member and in turn the satisfactory connection state between the cables by supporting the contact sections with the support surfaces.

According to the present invention, the elastic member preferably has a plurality of sites to contact with the contact surfaces of the contact sections of the terminals. With such the configuration, the elastic member contacts with the contact surfaces at the plurality of sites. Accordingly, it is possible to more securely keep the contacting state and increase the electrically conducted area than connecting at only one site.

According to the present invention, an electrical cable connector assembled member includes one electrical connector to be attached to one end of one of two cables to be connected at end sections; and another electrical connector to be attached to one end of the other of the cables so as to fit to the one electrical connector, and the cables can electrically connect to each other by fitting the electrical connectors to each other.

According to the present invention, in the electrical cable connector assembled member, the one electrical connector has one housing; and one terminal that has a contact section that has a contact surface parallel to a longitudinal direction of the cables and is to be held by the one housing. The other electrical connector has the other housing that has a receiving recess to receive one terminal; the other terminal that has a contact section having a contact surface parallel to the longitudinal direction of the cables and is to be held by the other housing; and a metal elastic member that is held by the other housing while being in a state of contacting with the contact surface of the contact section of the other terminal and partially protrudes in the receiving recess.

The elastic member can be elastically displaced in a direction perpendicular to the contact surfaces. In the state that the connectors are fitted to each other, the one terminal and the other terminal have their respective contact sections face each other having the overlapping range in the longitudinal direction, with a facing direction thereof being the direction perpendicular to the contact surface of the contact section. Further, the one terminal and the other terminal are respectively held in the one housing and the other housing so as to tightly press the elastic member in the facing direction by the contact surfaces within the overlapping range, and thereby electrically connected via the elastic member.

According to the present invention, the contact section of the one terminal and the contact section of the other terminal electrically connect to each other via the elastic member while securing desired contact pressure by tightly pressing the elastic member, which is provided in the overlapping range of the contact sections in the longitudinal direction of the cables in the connector fitting state, in the facing direction. Further, the contact sections are provided in the overlapping range in the longitudinal direction. Accordingly, it is possible to reduce a dimension of the electrical connector assembled member in the longitudinal direction.

As described above, according to the present invention, the contact sections of the respective terminals are provided having overlapping range in the longitudinal direction of the cables in the state that the cables are connected to each other. Accordingly, it is possible to reduce the size of the cable connecting configuration, the electrical cable connector, and the electrical cable connector assembled member by the amount of the overlapping range.

BRIEF DESCRIPTION OF THE DRAWINGS

FIGS. 2(A) and 2(B) are longitudinal sectional view showing the electrical cable connector and the two cables according to the first embodiment of the present invention, wherein FIG. 2(A) is a longitudinal sectional view showing the electrical cable connector and the two cables in a state before the cables are connected to the electrical cable connector, and FIG. 2(B) is a longitudinal sectional view showing the electrical cable connector and the two cables in the state that the cables are connected to the electrical cable connector;

FIGS. 6(A) and 6(B) are longitudinal sectional views showing the electrical cable connector assembled member according to the second embodiment of the present invention, wherein FIG. 6(A) is a longitudinal sectional view showing the electrical cable connector assembled member before the electrical cable connectors are fitted together, and FIG. 6(B) is a longitudinal sectional view electrical cable in a state that the electrical cable connectors are fitted to each other.

DETAILED DESCRIPTION OF PREFERRED EMBODIMENTS

Hereunder, referring to the accompanying drawings, embodiments of the present invention will be described.

First Embodiment

Figure 1:
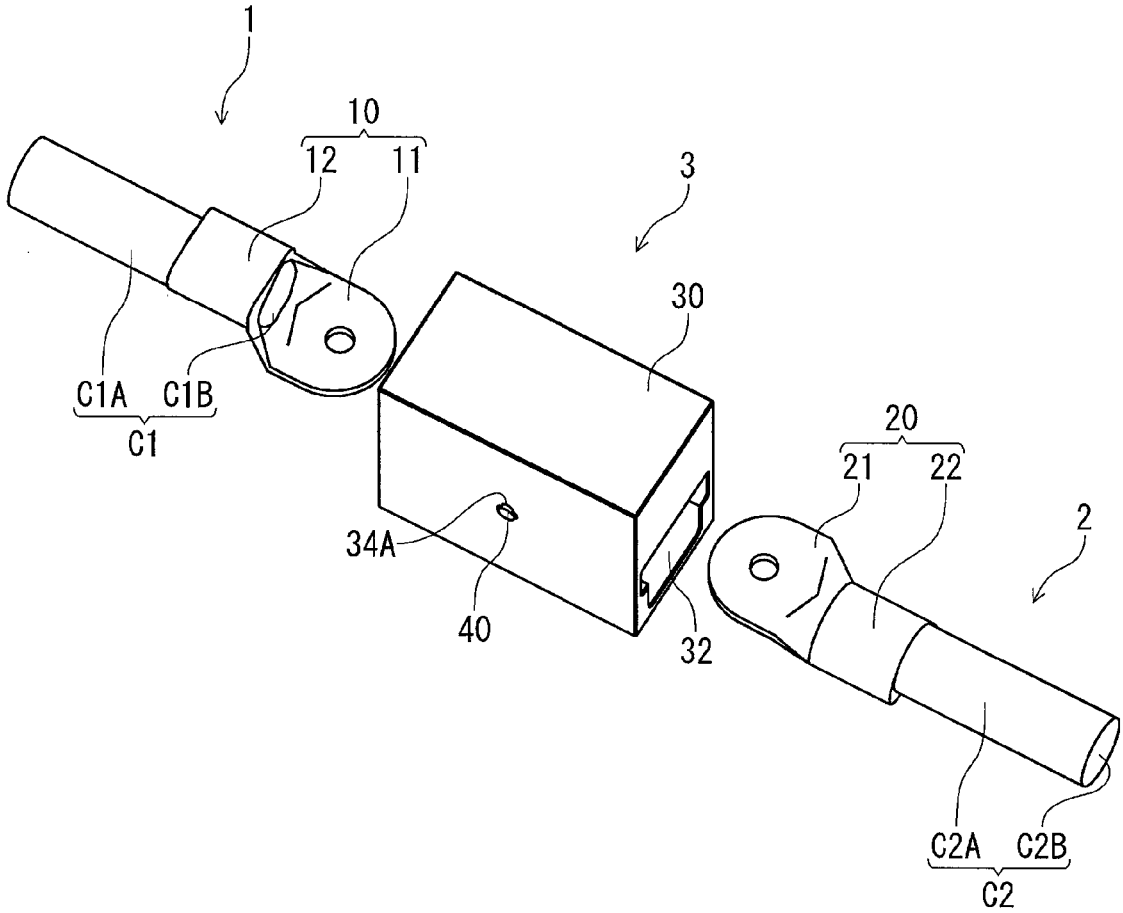
FIG. 1 is a perspective view showing an electrical cable connector and two cables in a state before the cables are connected to the electrical cable connector according to a first embodiment of the present invention.

A first embodiment of the present invention will be explained. FIG. 1 is a perspective view showing an electrical cable connector and two cables in a state before the cables are connected to the electrical cable connector according to a first embodiment of the present invention.

Figure 2A:
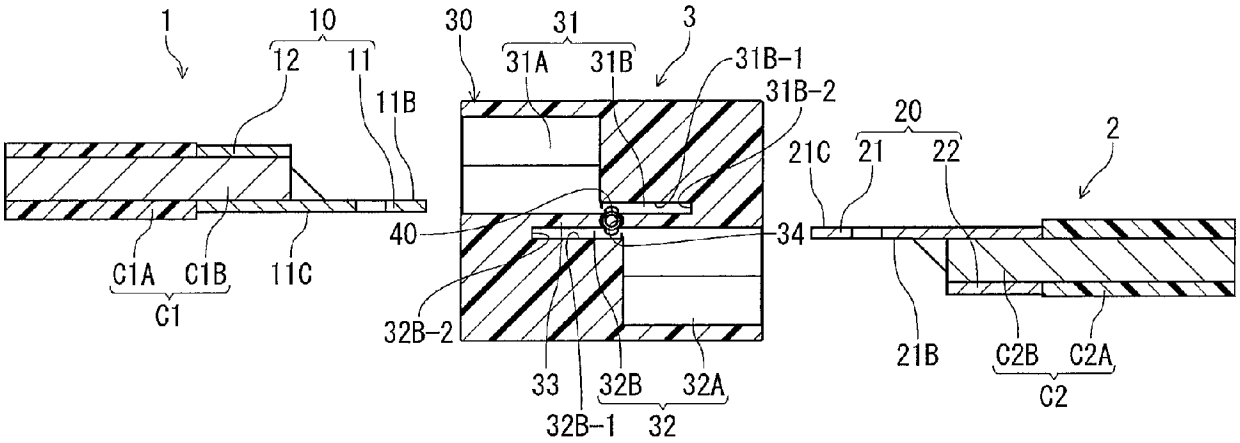
Figure 2B:
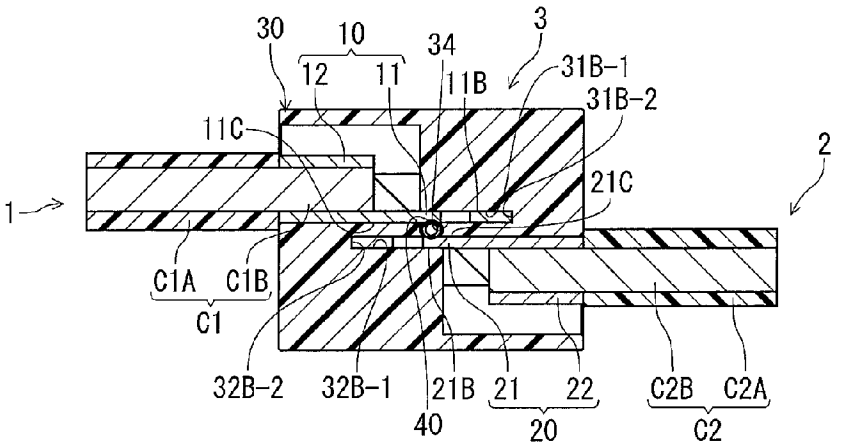

FIGS. 2(A) and 2(B) are longitudinal sectional view showing the electrical cable connector and the two cables according to the first embodiment of the present invention. More specifically, FIG. 2(A) is a longitudinal sectional view showing the electrical cable connector and the two cables in a state before the cables are connected to the electrical cable connector, and FIG. 2(B) is a longitudinal sectional view showing the electrical cable connector and the two cables in the state that the cables are connected to the electrical cable connector.

Figure 3:
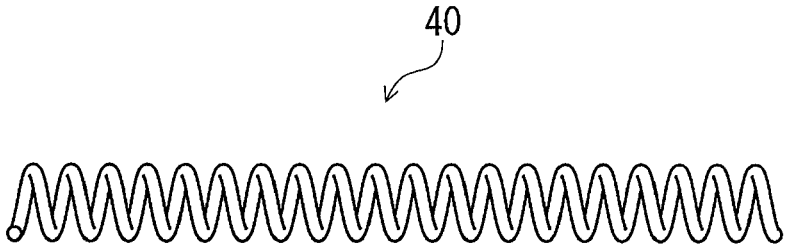
FIG. 3 is a side view showing an elastic member of the electrical connector according to the first embodiment of the present invention.

FIG. 3 is a side view showing an elastic member of the electrical connector according to the first embodiment of the present invention.

According to the embodiment, cables having terminals 1 and 2, which are shown in FIGS. 1, 2(A), and 2(B) are configured to electrically connect to each other via a electrical cable connector 3 (hereinafter simply referred to as "connector 3"). More specifically, the connectors having terminals 1 and 2 are inserted from opposite sides to each other in the cable's longitudinal direction (a left-and-right direction in FIGS. 1, 2(A), and 2(B)) to connect to each other.

As shown in FIG. 1, each cable having a terminal 1 and 2 has a terminal 10 and 20 attached at one end of each cable C1 and C2. As well shown in FIGS. 2(A) and 2(B), each cable C1 and C2 has a core wire C1B and C2B covered with a jacket C1A and C2A made of an electrically insulating material, and the core wire C1B and C2B is exposed at its one end from the jacket C1A and C2A, respectively.

The terminal 10 and the terminal 20 are general-purpose round crimp terminals (ring terminals). According to the embodiment, since general-purpose terminals are used, it is possible to reduce the cost. The terminal 10 and the terminal 20 are made of sheet metal and have an identical shape to each other. In the use condition of FIGS. 2(A) and 2(B), the terminals 10 and 20 connect to the cable C1 and C2, respectively, while being in symmetrical in positions and orientations in the left-and-right and the up-and-down directions.

Each terminal 10 and 20 has a flat contact section 11 and 21 for contacting with an elastic member 40 of the connector 3, which will be described later, having a flat sheet surface parallel to the cable's longitudinal direction; and a cable holding section 12 and 22 that is formed by rolling to a tubular shape and then crimping to the core wire C1B and C2B that is exposed at one end of the cable C1 and C2, so as to be attached to the cable C1 and C2, respectively. Each contact section 11 and 21 has its tip edge arched in the cable insertion direction (see FIG. 1).

As shown in FIGS. 2(A) and (B), of the two sheet surfaces that are front and back surfaces of the contact section 11 and 21, sheet surfaces provided on each cable C1 and C2 side, i.e. an upper surface of the contact section 11 and a lower surface of the contact section 21 in FIGS. 2(A) and (B), are surfaces to be supported 11B and 21B by support surfaces 31B-1 and 32B-1 of the housing 30. In addition, other sheet surfaces, i.e. a lower surface of the contact section 11 and an upper surface of the contact section 21 in FIGS. 2(A) and 2(B) are contact surfaces 11C and 21C that contact with the elastic member 40 as will be described below.

As shown in FIGS. 1, 2(A), and 2(B), the connector 3 includes a synthetic resin housing 30 having a generally rectangular prism shape; and a metal elastic member 40 to be held by the housing 30. As well shown in FIGS. 2(A) and 2(B), the housing 30 has receiving recesses 31 and 32 to receive the terminals 10 and 20 in the cable's longitudinal directions C1 and C2 (connector removing direction, which is a left-and-right direction in FIGS. 2(A) and (B)) formed therein.

While the receiving recess 31 is provided being opened leftward on an upper half part of the housing 30, the receiving recess 32 is provided being opened rightward at a lower half part of the housing 30. The receiving recess 31 and the receiving recess 32 are formed to have an identical shape to each other, and provided being inversed in the up-and-down direction and the left-and-right direction in relative to each other. In addition, those receiving recesses are formed at positions so as not to have overlapping range from each other in the up-and-down direction.

As shown in FIGS. 2(A) and (B), the receiving recess 31 has a primary space 31A to house the cable holding section 12 of the terminal 10 and a sub-space 31B to house the contact section 11 of the terminal 10. The primary space 31A is formed in range from the opening (left end position) to a position that is slightly off left from a center of the housing 30 in the left-and-right direction of FIGS. 2(A) and (B), and is suitably shaped for the cable holding section 12.

The sub-space 31B extends rightward from a lower part of a right end of the primary space 31A to reach generally a center of the right half part of the housing 30. The sub-space 31B has a groove-like shape suitable for the contact section 11 and has a slightly larger groove width than a sheet thickness of the contact section 11. An upper-side inner wall surface of the sub-space 31B is formed as a support surface 31B-1 that supports the surface to be supported 11B of the contact section 11 from thereabove, upon housing the contact section 11 within the sub-space 31B.

As already described above, since the receiving recess 32 has the same shape as that of the receiving recess 31, explanation of the receiving recess 32 will be omitted. In FIGS. 2(A) and (B), each part of the receiving recess 32 is denoted with reference numerals adding "1" to corresponding reference numerals of parts in the receiving recess 31.

As shown in FIGS. 2(A) and (B), the receiving recess 31 and the receiving recess 32 do not have overlapping range within the primary spaces 31A and 32A in the left-and-right direction. The sub-spaces 31A and 32B are formed partially having overlapping range, and are divided in the up-and-down direction by a dividing wall 33 in the range of the both sub-spaces 31B and 32B. As such, within the range of the dividing wall 33, a part of the primary spaces 31A and 32A and the sub-spaces 31B and 32B are provided, and as described above, the sub-space 31B and the sub-space 32B are overlapped at a center of the range.

The housing 30 has an elastic member holding hole 34, which is formed at a center of the dividing wall 33 in the left-and-right direction, i.e. at a position where the sub-space 31B and the sub-space 32B overlap, and extends in the connector width direction (a direction perpendicular to the paper surface of FIGS. 2(A) and 2(B)). The elastic member holding hole 34 is provided through to penetrate the housing 30 in the connector width direction, and penetrate the dividing wall 33 in the up-and-down direction.

As shown in FIG. 3, the elastic member 40 is formed as a coil spring-like metal member. The elastic member 40 is inserted from the opening 34A (see FIG. 1) of the elastic member holding hole 34 formed on a side wall surface of the housing 30 in the connector width direction, and is held within the elastic member holding hole 34 at a position where the total length range of the elastic member 40 in the axial direction and the range in the connector width direction are aligned.

According to the embodiment, the dimension of the elastic member 40 in the axial direction is set the same as the width dimension of the connector 3, but the dimension of the elastic member 40 is not limited in this way, and can be any as long as it is within the range of the width of the connector 3. Furthermore, according to the embodiment, as shown in FIG. 1, the opening 34A is left opened, but alternatively, it is also possible to close the opening 34A with a lid member (not illustrated) or the like.

As shown in FIG. 2(A), in a state before connecting the cables with terminals 1 and 2 to the connector 3, the elastic member 40 held in the elastic member holding hole 34 has its upper part protrude into the sub-space 31B of the receiving recess 31 and has its lower part protrude into the sub-space 32B of the receiving recess 32. More specifically, the upper part and the lower part protrude from sheet surfaces of the dividing wall 33 in the up-and-down direction. As will be described, the elastic member 40 elastically contacts with the contact surface 11C of the terminal 10 at its upper part, and elastically contacts with the contact surface 21C of the terminal 20 at its lower part.

As described above, since the elastic member 40 has a coil spring-like configuration, the upper part and the lower part that protrude into the receiving recesses 31 and 32 are present in a plurality of numbers corresponding to the number of windings of the coil about the axial direction of the elastic member 40. In other words, since the elastic member 40 elastically contacts with the contact surfaces 11C and 21C at a plurality of sites, it is possible to increase the electrically conducted area as well as securing the contact in comparison with when contacting at only one site.

The cable with a terminal 1 and the cable with a terminal 2 may be connected to each other as follows. First, as shown in FIG. 2(A), the cable with a terminal 1 is brought to a left side of the receiving recess 31 of the connector 3, with the contact surface 11C of the terminal 10 facing down. In addition, the cable with a terminal 2 is brought to a right side of the receiving recess 32 of the connector 3, with the contact surface 21C of the terminal 20 facing up.

Next, as shown in FIG. 2(B), the terminal 10 of the cable with a terminal 1 is inserted in the receiving recess 31 from the left side. The terminal 10 is inserted until a front end (right end in FIG. 2(B)) of the terminal 10 abuts with a groove-end wall section 31B-2 of the sub-space 31B of the receiving recess 31. In a state that insertion of the terminal 10 is completed, the cable holding section 12 of the terminal 10 is housed in the primary space 31A and a part of the contact section 11 is housed in the sub-space 31B.

Next, the cable with a terminal 2 is inserted in the receiving recess 32 of the connector 3 from the right side. Since the cable with a terminal 2 is inserted similarly to the insertion of the cable with a terminal 1 into the receiving recess 31 but inversing in the up-and-down direction and the left-and-right direction, the explanation is omitted.

As shown in FIG. 2(B), in a cable-connected state in which the cables C1 and C2 are inserted, the terminals 10 and 20 are provided such that the contact section 11 of the terminal 10 and the contact section 21 of the terminal 20 has overlapping range in the left-and-right direction, and the contact surface 11C of the contact section 11 and the contact surface 21C of the contact section 21 face to each other in the up-and-down direction. In addition, the surface 11B of the contact section 11 is supported by the support surface 31B-1 of the sub-space 31B from thereabove, and the surface 21B of the contact section 21 is supported by the support surface 32B-1 of the sub-space 32B from thereunder, so that the contact surface 11C and the contact surface 21C tightly press the elastic member 40 in the up-and-down direction. By the tight pressing, the elastic member 40 is elastically displaced to be compressed in the up-and-under direction, and elastically contacts with the contact surfaces 11C and 21C at a plurality of sites that are present in the axial direction (a direction perpendicular to the paper surface of FIG. 2(B)) of the elastic member 40. As a result, the terminal 10 and the terminal 20, and in turn the cable C1 and the cable C2 are electrical connected to each other via the elastic member 40.

According to the embodiment, the cable with a terminal 1 and the cable with a terminal 2 are inserted in the connector 3 in this order, but the order may be changed, or the cables 1 and 2 may be inserted at the same time.

According to the embodiment, in the state that the cables are connected to each other, since the contact section 11 of the terminal 10 and the contact section 21 of the terminal 20 are provided having overlapping range in the cable's longitudinal direction, it is possible to reduce the dimension of the terminals 10 and 20 and in turn the connector 3 in the longitudinal direction for the amount of the overlapping range. In addition, since it is possible to reduce the distance between the core wire C1B and the core wire C2B, it is possible to retain temperature increase of the connector 3 due to electrical continuity between the terminals 10 and 20 in the cable-connected state.

Furthermore, according to the embodiment, in the cable-connected state, the support surfaces 31B-1 and 32B-1 of the receiving recesses 31 and 32 of the housing 30 support the surfaces 11B and 21B of the contact sections 11 and 21 of the terminals 10 and 20 in the up-and-down direction. Accordingly, even when the cable with a terminal 1 or 2 or the connector 3 vibrates in the up-and-down direction, it is possible to keep the state of tightly pressing the elastic member 40 and in turn the satisfactory connection state between the cables C1 and C2.

According to the embodiment, the two cables with terminals are attached to the connector from the different directions from each other, but alternatively, it is also possible to attach the cables from the same direction. In this case, the two receiving recesses are provided being inversed in the up-and-down direction in relative to each other and opened in the same direction.

Figure 4:
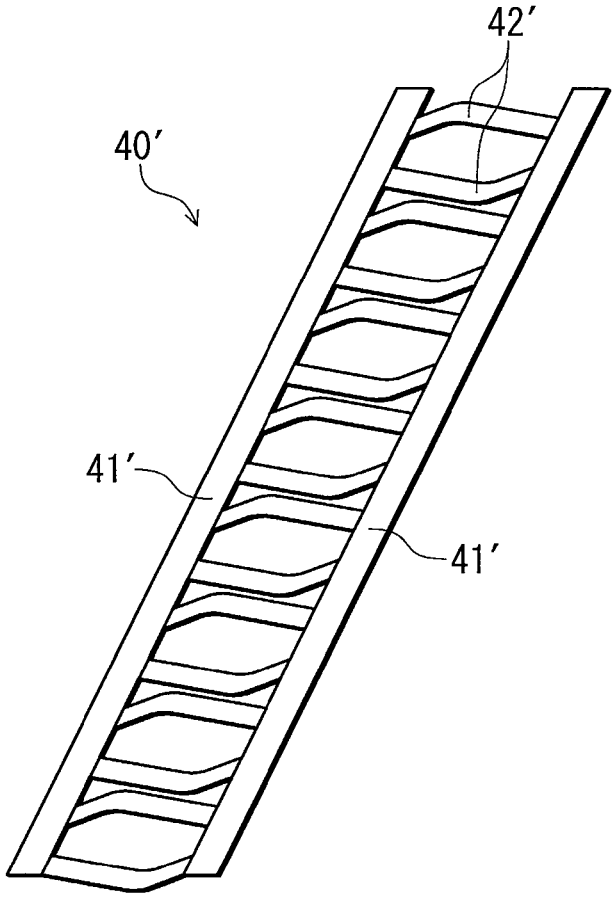
FIG. 4 is a perspective view showing a modification example of the elastic member of the electrical connector according to the first embodiment of the present invention.

According to the embodiment, the elastic member is configured to have a coil spring-like shape, but the shape of the elastic member is not limited to this and may have a shape as shown in FIG. 4. An elastic member 40' shown in FIG. 4 is formed to have a ladder-like shape by punching sheet metal, and has two edge sections 41' that extend in the longitudinal direction being parallel to each other; and a plurality of joint sections 42' that are arranged at certain intervals in the longitudinal direction and join the edges 41'. Moreover, a plurality of joint sections 42' arranged in the longitudinal direction is bent alternately upward and downward towards the front side and back side of the sheet metal to form an alternate up-and-down V-shape.

The elastic member 40' is held in the connector, with its longitudinal direction being aligned to the connector's width direction and with sheet surfaces of the elastic member 40' being perpendicular to the facing direction of the contact sections of the terminals. Then, the elastic member 40' elastically contacts with the contact surface of one terminal at bent parts of the joint section 42' that are bent upward, and elastically contacts with the contact surface of the other terminal at bent parts of the joint sections 42' that are bent downward.

Second Embodiment

A second embodiment of the present invention will be explained next. According to the second embodiment, two cables are connected by fitting connectors attached to one end of each cable to each other, which is different from the first embodiment in which two cables are inserted in one connector and connected to each other via the connector.

Figure 5:
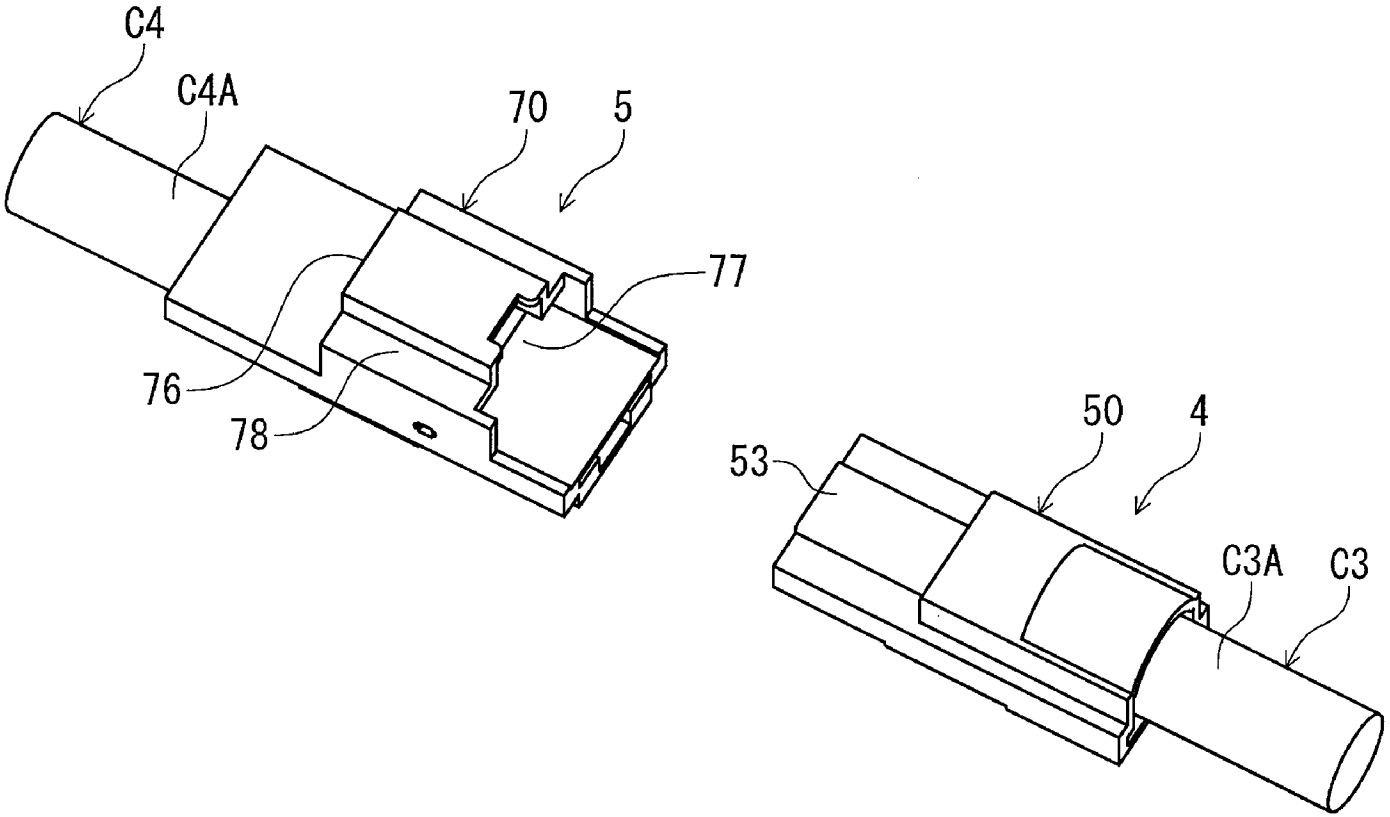
FIG. 5 is a perspective view showing an electrical cable connector assembled member in a state before electrical cable connectors are fitted together according to a second embodiment of the present invention.
Figure 6A:
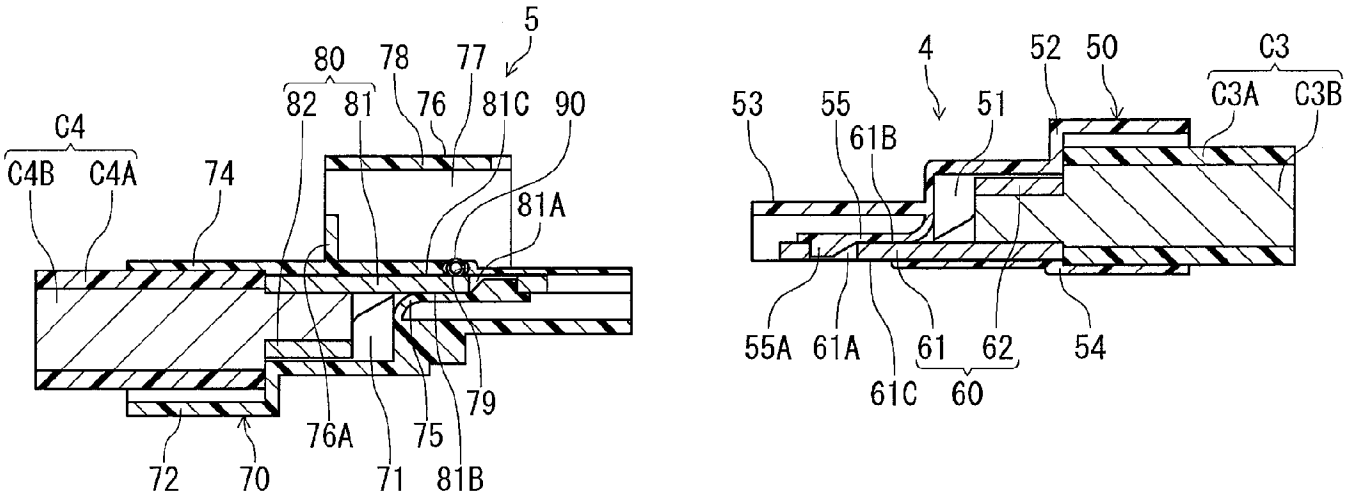
Figure 6B:
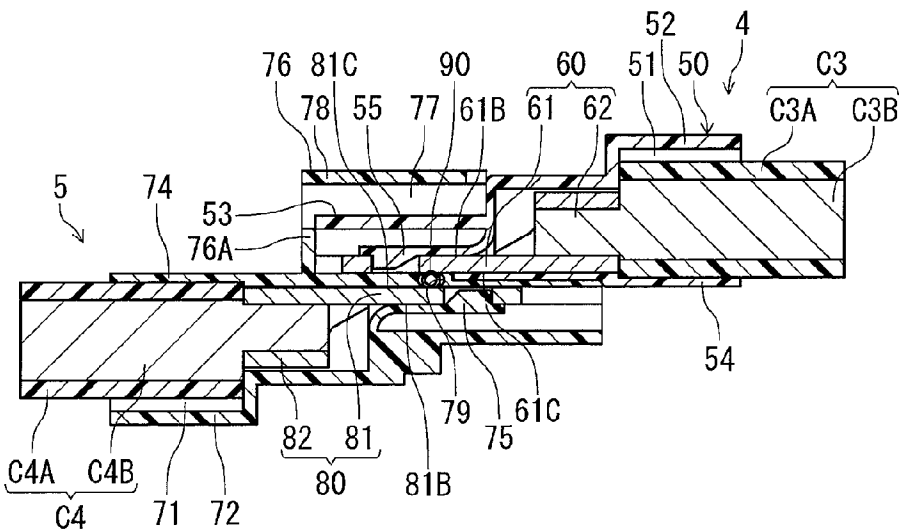

FIG. 5 is a perspective view showing an assembled member of an electrical cable connector, before fitting a connector. FIGS. 6(A) and 6(B) are sectional views of the electrical cable connector assembled member of FIG. 5, in which FIG. 6(A) is a sectional view before fitting connectors and FIG. 6(B) is a sectional view in the connector fitted state.

The connector assembled member of the embodiment includes a male connector 4 provided on the right side of FIGS. 5, 6(A), and 6(B) and a female connector 5 provided on the left side. The male connector 4 and the female connector 5 are fitted to each other in the cable's longitudinal direction (left-and-right direction in FIGS. 5, 6(A), and 6(B)). The male connector 4 is attached to one end of the cable C3, and includes a housing 50 made of synthetic resin, and a terminal 60 that is held by the housing 50 and connected to a core wire C3B of the cable C3. On the other hand, the female connector 5 has a housing 70 synthetic resin, a terminal 80 that is held in the housing 70 and connected to the core wire C4B of the cable C4, and a metal elastic member 90 that is to be held by the housing 70.

Since the terminals 60, 80, the elastic member 90, and the cables C3 and C4 are configured similarly to the terminals 10 and 20, the elastic member 40, and the cables C1 and C2 of the first embodiment, the explanation is omitted by denoting parts with reference numerals correspondingly to those in the first embodiment, and configurations of the housings 50 and 70 will be mainly described.

As shown in FIGS. 6(A) and 6(B), the housing 50 of the male connector 4 has a housing space 51 for housing terminals 60 that are connected to one end of the cable C3 and the core wire C3B of the cable C3, being formed to have a shape and dimension suitable to house them and penetrate in the left-and-right direction. The male connector 4 is assembled by inserting the terminal 60, which is connected to the core wire C3B, in the housing space 51 of the housing 50 from the right side.

The housing 50 has its upper wall 52 formed to have a step-like shape that is lower on the left side, respectively corresponding to the cable C3, the cable holding section 62 and the contact section 61 of the terminal 60, and a part that corresponds to the contact section 61 (the left-side part) is configured to have the least height. The part that corresponds to the contact section 61 serves as a fitting section 53 to be fitted in the receiving recess 77 of the female connector 5, which will be described later, upon connector fitting.

As shown in FIGS. 6(A) and (B), a lower wall 54 of the housing 50 is not provided at a position that corresponds to the fitting section 53 in the left-and-right direction, and a lower surface of the contact section 61 of the terminal 60, i.e. the contact surface 61C, is exposed to therebelow. On an upper wall 52 at a position of the fitting section 53, there is provided a support arm 55, which extends downward at a right end of the lower surface of the upper wall 52, and then bent leftward. The support arm 55 can be elastically displaced in the up-and-down direction, and supports an upper surface of the contact section 61 of the terminal 60, i.e. the surface 61B so as to press it from thereabove. The contact section 61 has a hole 61A formed thereon.

On a lower surface of a free end of the support arm 55, i.e. a left end thereof, there is formed a locking protrusion 55A that protrudes downward and enters the hole 61A of the contact section 61 of the terminal 60 from thereabove, and thereby prevents the terminal 60 from displacement rightward by locking a left end surface of the locking protrusion 55A onto an inner wall surface of the hole 61A. In addition, a right end surface of the locking protrusion 55A is formed as a tapered surface that tilts downward towards the left side. When the terminal 60 is inserted leftward to the housing space 51 of the housing 50 upon assembling the male connector 4, the left end of the terminal 60 abuts to the tapered surface and thereby the support arm 55 can elastically displace upward. With the elastic displacement of the support arm 55, the terminal 60 can be inserted further deeply, and once insertion of the terminal 60 is completed, the support arm 55 returns to its free state and the locking protrusion 55A enters the hole 61A from thereabove.

As shown in FIGS. 6(A) and 6(B), the female connector 5 to be fitted to the male connector 4 is configured almost similarly to the male connector 4 by being inversed in the up-and-down direction and left-and-right direction, except that the receiving recess 77 to receive the fitting section 53 of the male connector 4 is formed on the housing 70 and the elastic member 90 is provided. Therefore, as for the female connector 5, the receiving recess 77 and the elastic member 90 will be mainly described, denoting the parts that corresponds to those of the male connector 4 by adding "20" to the reference numerals of the male connector 4, and the explanation will be omitted.

As shown in FIGS. 6(A) and 6(B), the housing 70 has a tubular section 76 on an upper wall 74 at a position that corresponds to a contact section 81 of the terminal 80 in the left-and-right direction (see also FIG. 5). The tubular section 76 has a space opened leftward that is formed therein, and the space forms a receiving recess 77 to receive the fitting section 53 of the male connector 4.

An upper wall 78 of the tubular section 76 is formed lower than a center position near the edges in the connector's width direction, and the height dimension of the receiving recess 77 near the edges is slightly larger than the height dimension near the edges of the fitting section 53 of the male connector 4. Therefore, in a connector fitted state, the upper wall 78 supports an upper surface of the fitting section 53 from thereabove near the both edges, which prevents the fitting section 53 from moving up.

As well shown in FIGS. 6(A) and (B), the upper wall 74 of the housing 70 is within range of the contact section 81 of the terminal 80 in the left-and-right direction, and has an elastic member holding hole 79, which extends in the connector's width direction (a direction perpendicular to the paper surface of FIGS. 6(A) and (B)), within range of the contact section 81 of the terminal 80 in the left-and-right direction, being closer to the left side than the hole 81A formed at the contact section 81. The elastic member holding hole 79 penetrates the upper wall 74 in the connector's width direction and in the up-and-down direction.

The elastic member 90 is formed as a coil spring-like metal member similarly to the elastic member 40 of the first embodiment, and being inserted from an opening 79A (see FIG. 5) of the elastic member holding hole 79 formed on a side wall surface of the housing 70, the elastic member 90 is held in the elastic member holding hole 79, with the total length range of the elastic member 90 in the axial direction and the range of the connector's width direction being aligned. As shown in FIG. 6(A), in a state before connector fitting, the elastic member 90 has its upper part protrude in the receiving recess 77, and its lower part elastically contact with a contact section 81C of the terminal 80.

Next, procedure of fitting connectors will be described. As shown in FIG. 6(A), the fitting section 53 of the male connector 4 is brought to a position that face the opening of the receiving recess 77 of the female connector 5, and then the fitting section 53 is fitted from the right side into the receiving recess 77. The fitting of the fitting section 53 is completed by abutting of the left-end surface of the fitting section 53 to the groove-end wall section 76A of the receiving recess 77.

As shown in FIG. 6(B), in the state of completion of the connector fitting, a contact surface 61C of the terminal 60 of the male connector 4 presses an upper portion of the elastic member 90 downward to elastically contact with elastic member 90. Accordingly, the elastic member 90 is tightly pressed by the contact surface 61C and the contact surface 81C of the terminal 80 of the female connector 5 in the up-and-down direction. As a result, the male connector 4 and the female connector 5, and in turn the cable C3 and the cable C4 are electrically connected to each other via the elastic member 90.

According to the embodiment, in the connector fitted state, the contact section 61 of the terminal 60 of the male connector 4 and the contact section 81 of the terminal 80 of the female connector 5 are provided having overlapping range in the cable's longitudinal direction, so that it is possible to reduce the dimension of the assemble of the male connector 4 and the female connector 5 in the longitudinal direction for the amount of the overlapping range. In addition, since it is possible to reduce the distance between the core wire C1B and the core wire C2B, it is possible to restrain temperature increase of the connector assembled member due to electrical connection between the terminals 60 and 80 in the connector fitted state.

As already described above, according to the embodiment, since the upper wall 78 of the tubular section 76 of the female connector 5 supports the fitting section 53 of the male connector 4 near the edges in the connector's width direction from thereabove, the state of elastic contact of the contact surface 61C of the terminal 60 to the elastic member 90 is maintained without lifting the fitting section 53 of the male connector 4.

In addition, as for the male connector 4, the support arm 55 of the housing 50 presses the surface 61B of the terminal 60 downward to support, whereas as for the female connector 5, the support arm 75 of the housing 70 presses the surface 81B of the terminal 80 upward to support. Therefore, even when the both connectors vibrate in the up-and-down direction, the state that the contact surface 61C and the contact surface 81C tightly press the elastic member 90 in the up-and-down direction is securely maintained.

According to the embodiment, as shown in FIG. 6(A), the receiving recess 77 of the female connector 5 is opened rightward so as to be able to receive the fitting section 53 of the male connector 4 from the right side, but alternatively, it is also possible to form the opening of the receiving recess on the opposite side in the cable's longitudinal direction, i.e. on the left side of FIG. 6(A), so as to be able to accept the fitting section 53 from the left side.

Third Embodiment

Figure 7:
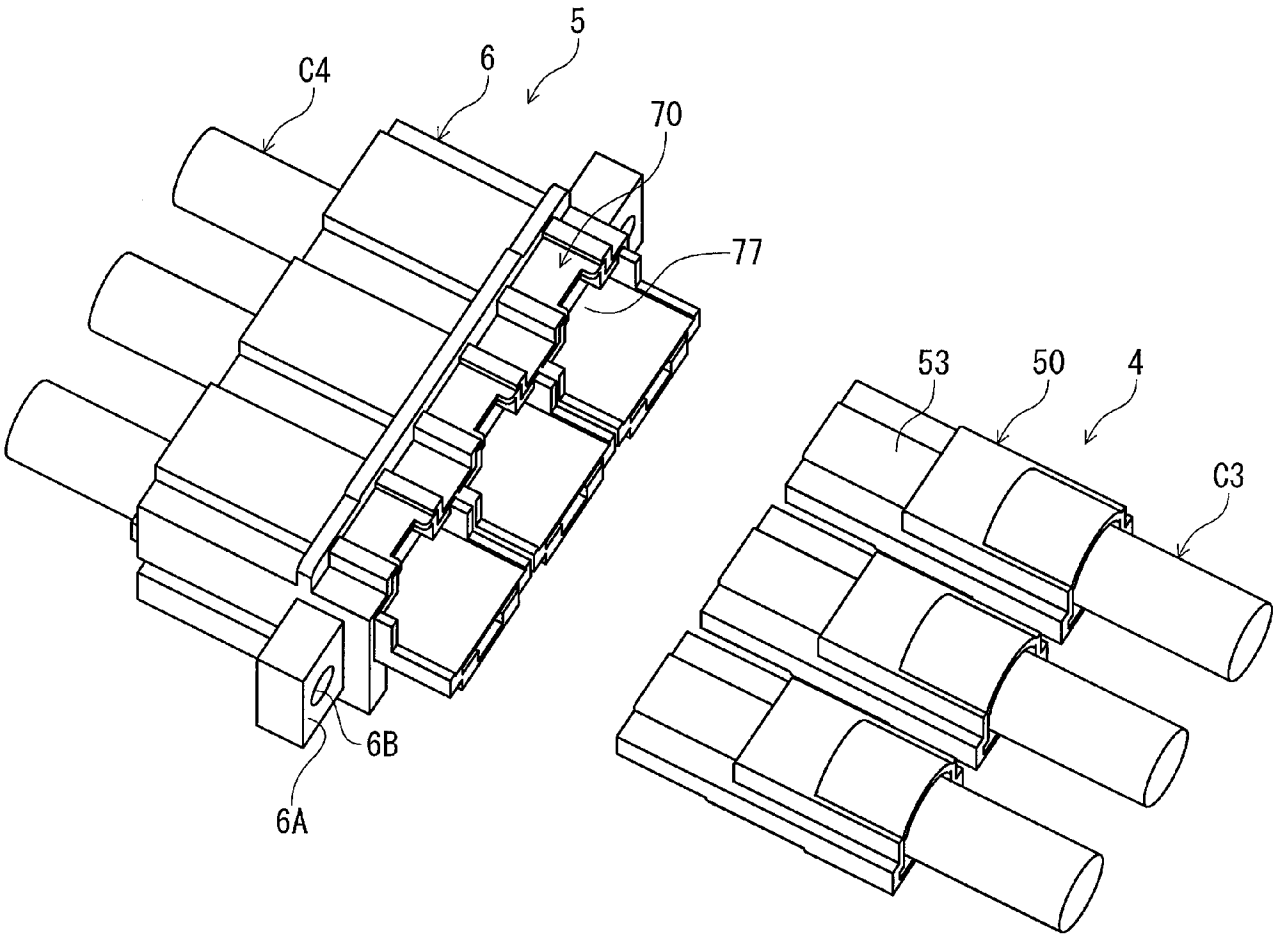
FIG. 7 is a perspective view showing an electrical cable connector assembled member in a state before electrical cable connectors are fitted together according to a third embodiment of the present invention.

A third embodiment of the present invention will be explained next. According to the third embodiment, a plurality of male connectors respectively fits and connects to corresponding female connectors, while the female connectors are being arranged and held by one cover member, which is different from the second embodiment, in which the female connectors fit and connect to the male connectors without such cover member to arrange and hold the female connectors. FIG. 7 is a perspective view of an electrical connector assembled member of the third embodiment before connector fitting.

Configurations of each male connector 4 and female connector 5 of the embodiment are the same as those in the second embodiment, and there are three each of the male connectors 4 and the female connectors 5 are provided. In addition, in FIG. 7, the same parts as those in the second embodiment are denoted with the same reference numerals and the explanation is omitted.

As shown in FIG. 7, according to the embodiment, a plurality of female connectors 5 (three female connectors 5 in the illustrated embodiment) is arranged and held in the width direction of the female connectors 5 by one cover member 6. The cover member 6 has connector holding holes to hold the plurality of female connectors 5, which are formed penetrating in the cable's longitudinal direction of the female connectors 5. Being inserted rightward from the opening at the left end of the connector holding hole in FIG. 7, the plurality of female connectors 5 is held within the connector holding hole.

Furthermore, the cover member 6 has on the both ends in the width direction an attachment section 6A that extends outward in the width direction. Each attachment section 6A has an attachment hole 6B that penetrates in the left-and-right direction of FIG. 7 (a longitudinal directions of the cables C3 and C4), so as to be able to attach the cover member 6 to a casing of an electronic device (not illustrated) or the like by inserting screws or the like in the attachment holes 6B.

According to the embodiment, respectively fitting the fitting sections 53 of the female connector 4 into the corresponding receiving recesses 77 of the plurality of female connectors 5 arranged and held in the cover member 6, it is possible to electrically connect the plurality of pairs (three pairs in the illustrated embodiment) of cables.

In addition, even in the embodiment, similarly to the second embodiment, it is possible to miniaturize of the connector assembled member in the cable's longitudinal direction and restrain temperature increase of the connector by electrical connection between terminals.

In the embodiment, as shown in FIG. 7, the receiving recess 77 of the female connector 5 is opened rightward so as to receive the fitting section 53 of the male connector 4 from the right side, but alternatively, it is also possible to form the opening of the receiving recess 77 on the opposite side in the cable's longitudinal direction, i.e. on the left side in FIG. 7, so as to be able to receive the fitting section 53 from the left side.

The disclosure of Japanese Patent Application No. 2010-198251, filed on Sep. 3, 2010 is incorporated in the application by reference.

While the present invention has been explained with reference to the specific embodiments of the present invention, the explanation is illustrative and the present invention is limited only by the appended claims.

What is claimed is:

1. An electrical cable connector assembled member for connecting a first cable and a second cable, comprising:

a first electrical cable connector to be attached to a first terminal of the first cable, said first electrical cable connector including a first housing having a first receiving portion for receiving the first terminal; and a second electrical cable connector to be attached to a second terminal of the second cable, said second electrical cable connector including a second housing having a second receiving portion for receiving the second terminal and an elastic member disposed in the second housing for electrically connecting the first terminal and the second terminal, wherein said second receiving portion is configured so that the first terminal is overlapped with the second terminal in an overlapping region along a connecting direction in which the first electrical cable connector is connected to the second electrical cable connector, and said elastic member is configured so that the first terminal and the second terminal sandwich the elastic member in the overlapping region when the first electrical cable connector is connected to the second electrical cable connector.

2. The electrical cable connector assembled member according to claim 1, wherein said first receiving portion includes a first main space portion for accommodating a first cable holding portion of the first terminal and a first sub space portion for accommodating a first contact portion of the first terminal, said first sub space portion being configured to communicate with the first main space portion so that the first sub space portion is situated at a backside of the first main space portion.

3. The electrical cable connector assembled member according to claim 2, wherein said first main space portion is configured to have a size greater than that of the first sub space portion.

4. The electrical cable connector assembled member according to claim 2, wherein said first sub space portion includes a first supporting surface portion for supporting the first contact portion so that the first contact portion is pressed against the elastic member.

5. The electrical cable connector assembled member according to claim 1, wherein said elastic member is formed in a coil shape having a plurality of contact points so that specific ones of the contact points contact with the first contact portion.

6. The electrical cable connector assembled member according to claim 1, wherein said second housing further includes a receiving recess for receiving the first electrical cable connector, said receiving recess being situated adjacent to the second receiving portion in a direction perpendicular to the connecting direction.

7. The electrical cable connector assembled member according to claim 6, wherein said elastic member is disposed so that the elastic member protrudes into the receiving recess.

* * * * *